US006504460B2

(12) United States Patent
DeGrazia et al.

(10) Patent No.: US 6,504,460 B2
(45) Date of Patent: Jan. 7, 2003

(54) ACTUATOR MECHANISM FOR AN EXTERNAL CIRCUIT BREAKER OPERATING DEVICE

(75) Inventors: Dean Basil DeGrazia, Pittsburgh, PA (US); Erik Russell Bogdon, Carnegie, PA (US); James Alan Trax, Oakdale, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/836,427

(22) Filed: Apr. 17, 2001

(65) Prior Publication Data

US 2002/0149451 A1 Oct. 17, 2002

(51) Int. Cl.[7] ..... H01H 3/00
(52) U.S. Cl. ..... 335/68; 200/329
(58) Field of Search ..... 335/68–72, 202; 200/329–332.2, 43.14–43.15

(56) References Cited

U.S. PATENT DOCUMENTS 5,663,862 A * 9/1997 Hopping-Mills ..... 361/672
5,875,886 A * 3/1999 Elster ..... 200/331

* cited by examiner

*Primary Examiner*—Lincoln Donovan
(74) *Attorney, Agent, or Firm*—Martin J. Moran

(57) ABSTRACT

An actuator mechanism, for a circuit breaker having an operating handle, which includes a slider assembly and a mounting plate assembly. The slider assembly has a rigid, generally planar member with at least one notch. The mounting plate assembly has at least two generally parallel, spaced flanges and is structured to mount on the circuit breaker housing. One of the at least two flanges is structured to cooperate with the notch to allow the slider assembly to be slidably coupled to the mounting plate between the at least two flanges.

23 Claims, 4 Drawing Sheets

ACTUATOR MECHANISM FOR AN EXTERNAL CIRCUIT BREAKER OPERATING DEVICE

BACKGROUND OF THE INVENTION

1. Field of the Invention

The present invention relates to an external operating device for a molded case circuit breaker and, more particularly, to an actuator mechanism having assembly notches in a slider assembly and a mounting plate having attachment points located to the side of the circuit breaker operating handle, adapted to be coupled to a circuit breaker operating handle, for moving the operating handle to an open position or, alternatively, to a closed position, which may be controlled from a handle that is external to the circuit breaker enclosure.

2. Description of the Prior Art

Molded case circuit breakers are generally used to provide overcorrect protection for various types of electrical equipment. However, in some applications, it is desirable to have an operating device for the circuit breaker that is external to the circuit beaker enclosure. Such external operators make it easier to operate the circuit breakers. Such a remote control system is also useful for molded case switches.

In such applications, external operators have been provided that are adapted to be mechanically coupled to the operating handle of the circuit breaker or molded case switch. The external operator is, typically, a lever or handle attached to a cable. The cable is coupled to an actuator assembly mounted on the face of the circuit breaker. The actuator assembly includes a mounting plate assembly and a slider assembly. The slider assembly includes a rigid member having a formed cutout sized to fit about the operating handle of the circuit breaker. The slider assembly further includes a bent tab coupled to the cable When the external operating handle is actuated, the cable acts on the slider assembly which moves the circuit breaker operating handle between the open and closed position. The prior art actuator assemblies suffer from at least two disadvantages. First, one type of actuator assembly has three components, a slider assembly, a first mounting plate and a second mounting plate. It would be more cost effective to reduce the number of components. Additionally, the two-part mounting brackets were attached by two fasteners on each bracket. Should the fasteners on either one of the mounting brackets become unattached to the circuit breaker, the entire device may be rendered inoperable. Some actuator assemblies have only one mounting plate assembly, and thus only two parts. The slider assembly tab is inserted into the bracket and the slider is fished through the slot until the end opposite the tab can be inserted into the bracket. A portion of the slider assembly is wider than one of the slots, thus, the slider assembly is captured in the slots by the bent tab and the wide portion. Manufacturing costs and procedure could be simplified if the slider assembly were more easily installable.

A second disadvantage of the prior art actuator assemblies is that the mounting plate assemblies typically placed the bracket fastener openings within, or near, the generally straight path of travel of the circuit breaker operating handle. That is, for a circuit breaker mounted with the operating handle moving between an "up" position and a "down" position, the mounting plate assembly attachment openings would be located above and below the operating handle. In certain models of circuit breakers, a trip unit is disposed in the area "below" the actuating handle. Use of the prior art mounting plate assembly would interfere with adjustment controls on the trip unit.

Therefore, there is a need for an actuator assembly that can be more easily assembled in the field.

There is further need for an actuator assembly, to be used with circuit breakers having a trip unit with controls disposed adjacent to a circuit breaker operating handle, with a mounting plate that does not block access to the trip unit controls.

SUMMARY OF THE INVENTION

These needs and other needs are satisfied by the present invention which provides an actuator assembly having a slider assembly having a wide portion and a narrow portion, and a mounting plate assembly having an open slot sized to cooperate with the narrow portion to allow the slider assembly to be inserted into the mounting plate assembly. The slider assembly is a rigid, generally planar member. The planar member includes at least one lateral notch disposed between the wide portion and the narrow portion. At the location of the notch, the planar member has a reduced width. The wide portion includes a formed cutout. The slider assembly also includes a tab that is generally perpendicular to the planar member. The mounting plate assembly includes two slots, a first slot sized to correspond to the slider assembly narrow portion, and a second slot sized to correspond to the slider assembly wide portion. The first slot has a partially open top that is sized to correspond to reduced width of the planar member at the location of the notch.

To construct the actuator assembly, the slider assembly is inserted into the mounting plate assembly by passing the reduced width portion of the rigid planar member through the opening in the partially open first slot. The wide portion of the slider assembly is then aligned with the second slot. The narrow portion is then slid through the first slot until the wide portion enters the second slot. Once assembled, the narrow portion is constrained by the first slot and the wide portion is constrained by the second slot. Thus, the actuator assembly may be constructed out of only two components and be assembled in the field.

Additionally, the mounting plate assembly is structured with mounting openings that are attached to the faceplate on either side of the circuit breaker operating handle. That is, spaced to the sides of the path of travel of the operating handle. As such, the mounting plate assembly does not extend to the area occupied by the trip unit. Therefore, the mounting plate assembly does not block access to the trip unit controls or prevent the opening of a flip lid over the trip unit controls.

DESCRIPTION OF THE DRAWINGS

These and other advantages of the present invention will become readily apparent upon consideration of the following detailed description and attached drawing, wherein.

DETAILED DESCRIPTION OF A PREFERRED EMBODIMENT

As used herein, "correspond" indicates that two structural components are sized to engage each other with a minimum amount of friction. Thus, an opening which corresponds to a member is sized slightly larger than the member so that the member may pass through the opening with a minimum amount of friction.

Figure 1:
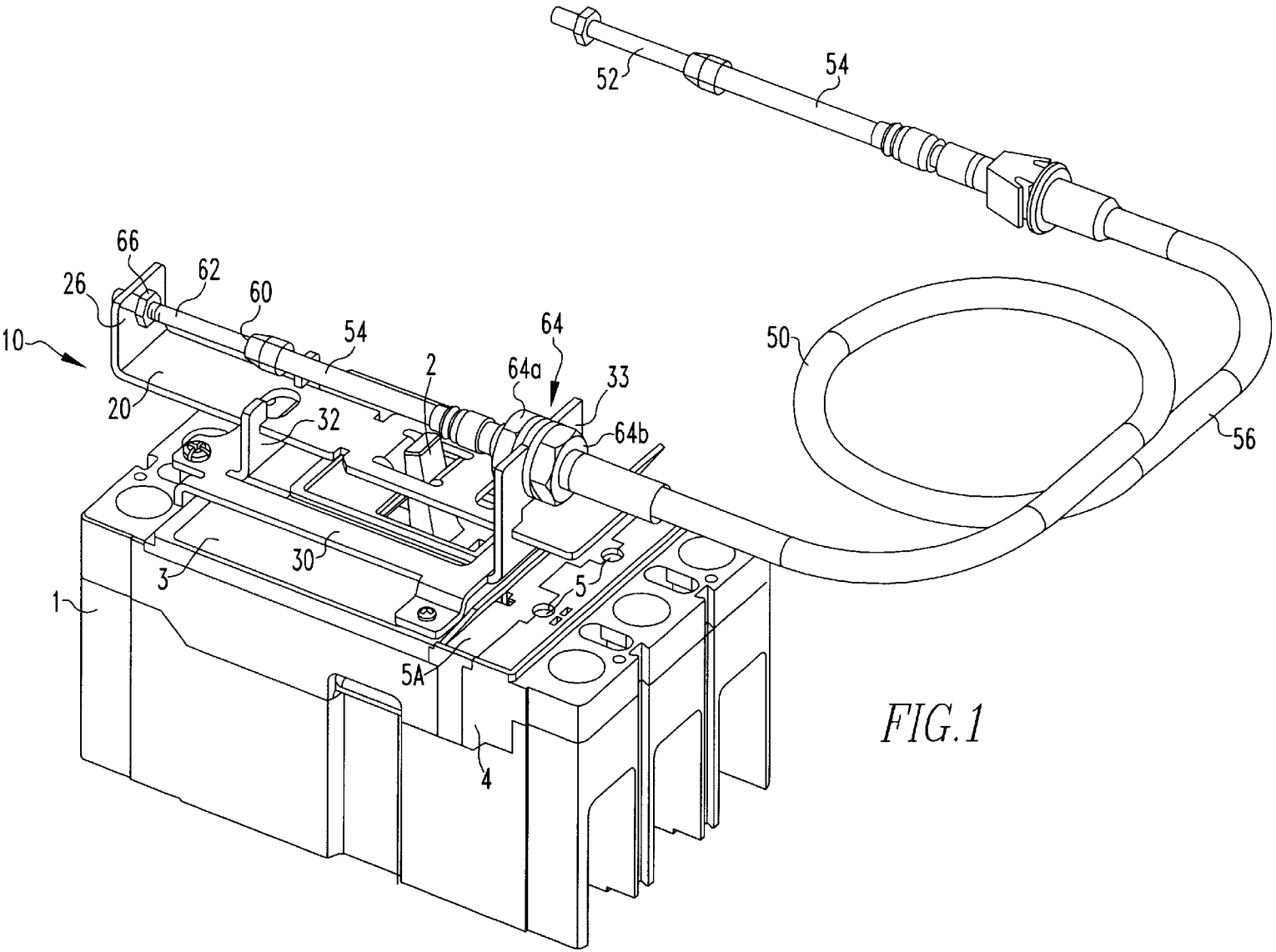
FIG. 1 is an isometric view of actuator assembly in accordance with the present invention mounted on a molded case circuit breaker.

As shown in FIG. 1, an actuator assembly 10 in accordance with the present invention is shown coupled to a molded case circuit breaker 1. The molded case circuit breaker is typically disposed within an enclosure (not shown). The actuator assembly 10 is typically coupled to an external handle assembly (not shown) that is mounted outside of the enclosure. The molded case circuit breaker 1 includes an outwardly extending operating handle 2, a faceplate 3, and a trip unit 4. The trip unit 4 includes adjustable controls 5 and/or a flip lid 5A covering the controls 5. Such circuit breakers 1 include a pair of separable main contacts (not shown) controlled by the operating handle 2. The operating handle 2 pivots between an open position, wherein the main contacts are separated, and a closed position, wherein the main contacts are closed. The distance the operating handle 2 travels as it pivots between the open position and the closed position is the operating handle "stroke."

The actuator assembly 10, as shown in FIGS. 1 and 2*a*–2*c*, includes a slider assembly 20 and a mounting plate assembly 30. As shown best in FIG. 2*a*, the slider assembly 20 includes a rigid, generally planar member 21. In the preferred embodiment, the planar member 21 includes a narrow portion 22 and a wide portion 23. Between the narrow portion 22 and the wide portion 23 is at least one notch 24. In the preferred embodiment there are two notches 24*a*, 24*b*. The notches 24*a*, 24*b* extend laterally inward from two opposing sides 18, 19 of the planar member 21. Between the notches 24*a*, 24*b*, the planar member 21 has a reduced width portion 28 which is more narrow than the narrow portion 22. The wide portion 23 includes a formed cutout 25 which is sized to fit closely about operating handle 2. The formed cutout 25 includes two extensions 29 which, when the actuator assembly 10 is installed on a circuit breaker 1, extend toward the circuit breaker faceplate 3. The narrow portion 22 includes an integral tab 26 that is generally perpendicular to planar member 21. The tab 26 has a shaft opening 27 therein.

The mounting plate assembly 30 includes a generally planar body 31 having a generally perpendicular first flange 32 at one end and a generally perpendicular second flange 33 at the opposite end. Thus, the flanges 32, 33 are generally parallel and spaced apart. The generally planar body 31 also includes at least one first attachment opening 34 and at least one second attachment opening 35. The at least one first attachment opening 34 may be disposed on a tab 36 which extends from generally planar body 31 and may be disposed in a different, but generally parallel plane, to the generally planar body. The first flange 32 includes a partially open, first slot 37. The first slot 37 is sized to correspond to the narrow portion 22 of the slider assembly 20. The first flange 32 further includes an opening 38 that communicates with first slot 37, thereby making the first slot 37 "partially open." The first flange opening 38 is sized to correspond to the notches 24 on the planar member 21 of the slider assembly 20. The first flange opening 38 is narrower than the narrow portion 22 of slider assembly 20. The second flange 33 includes a second slot 39 sized to correspond to the wide portion 23 of the slider assembly 20. The second flange also includes a mounting opening 40. The mounting opening 40 is a slot located adjacent to the distal edge of the second flange 33. The mounting opening 40 is sized to fit outside of the flexible shaft assembly 50 (described below).

Figure 2A:
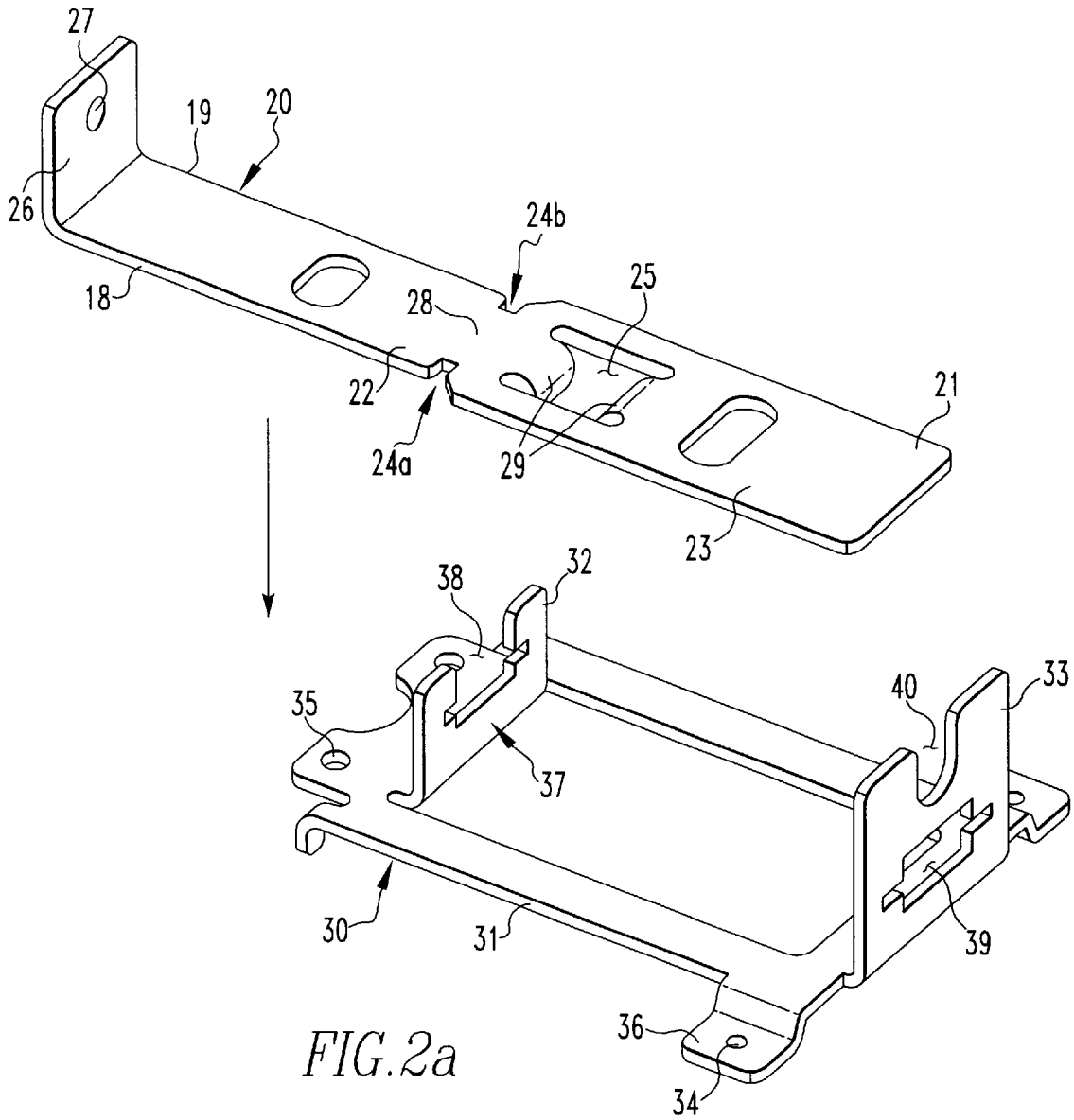
FIGS. 2*a*–2*c* are isometric views illustrating the construction steps that couples the slider assembly to the mounting plate assembly.
Figure 2B:
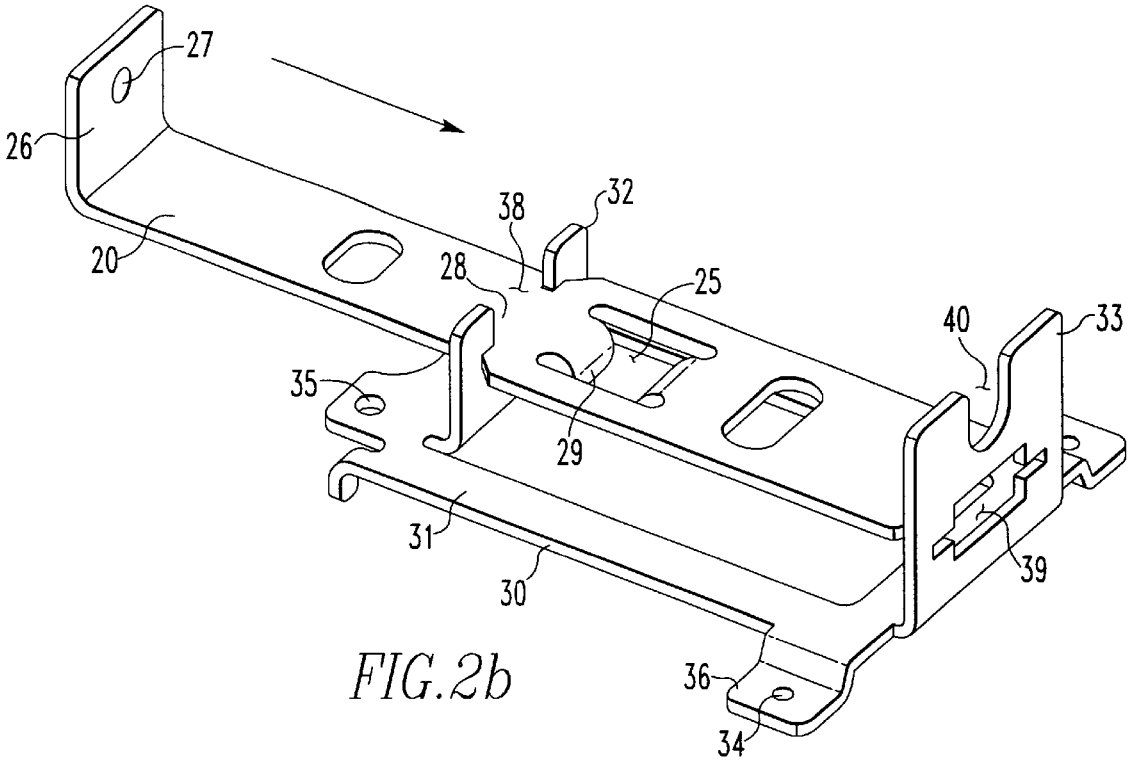
Figure 2C:
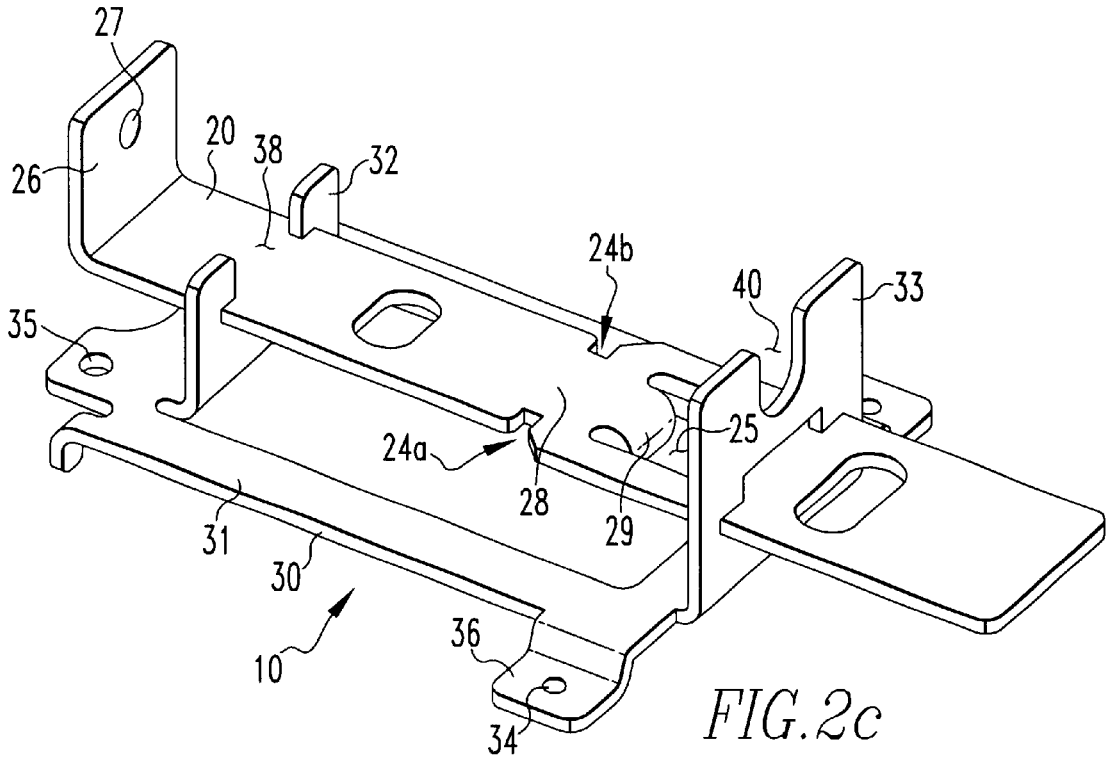

The steps for constructing the actuator assembly 10 are shown in FIGS. 2*a*–2*c*. Initially, the slider assembly 20 and the mounting plate assembly 30 are separated. The slider assembly 20 is inserted into the first flange 32 by passing planar member 21, at notches 24, through first flange opening 38. The wide portion 23 is disposed near second flange 33 and the slider assembly tab 26 is opposite second flange 33. When slider assembly 20 is inserted into the first slot 37, the slider assembly 20 is moved, or slid, toward the second flange 33 so that wide portion 23 may be inserted into the second slot 39. As the slider assembly 20 is being moved, the narrow portion 22 moves into the first slot 37. Once the notches 24 are not aligned with first flange opening 38, the slider assembly 20 is slidably captured in the mounting plate assembly 30.

As shown on FIG. 1, the actuator assembly 10 is structured to be coupled to the circuit breaker 1. When the actuator assembly 10 is coupled to the circuit breaker 1, the at least one first attachment opening 34 is structured to be aligned with a fastener opening (not shown) on faceplate 3. The fastener opening on the faceplate 3 is spaced to the side of the operating handle 2 and not in the direction the operating handle 2 travels as the operating handle 2 moves between the open and closed positions. As such, neither the slider assembly 20 nor the mounting plate assembly 30 blocks access to the trip unit controls 5. Additionally, the operating handle 2 is passed through formed cutout 25.

The formed cutout 25 and the notches 24*a*, 24*b* are spaced apart on planar member 21. The spacing of the formed cutout 25 and the notches 24*a*, 24*b* is such that, when the actuator assembly 10 is installed on a circuit breaker 1 and the formed cutout 25 engages the operating handle 2, the slider assembly 20 will not travel a sufficient distance, relative to mounting plate assembly 30, to allow the notches 24*a*, 24*b* to align with opening 38 as the operating handle 2 moves through its stroke. As such, the operating handle 2 aids in capturing the slider assembly 20 in first slot 37 and second slot 39 because the stroke of the operating handle 2 limits the travel of the slider assembly 20 so that the notches 24*a*, 24*b* cannot become aligned with the opening 38. In other words, when the operating handle 2 engages the formed cutout 25, the notches 24*a*, 24*b* cannot be aligned with the opening 38.

The slider assembly 20 is coupled to a flexible shaft assembly 50. The flexible shaft assembly 50 includes a handle attachment end 52 and an actuator attachment end 60. The handle attachment end 52 may be coupled to a handle (not shown) that is disposed outside of the circuit breaker enclosure. The flexible shaft assembly 50 also includes a cable, or flexible shaft 54 that is partially disposed within an outer sheath 56. The actuator attachment end 60 includes a threaded end 62 and a mounting means, such as a double nut mounting 64. The threaded end 62 is sized to pass through tab opening 27. Two nuts 66 (one shown) are threaded onto threaded end 62 on either side of tab 26, thereby capturing tab 26 between the two nuts 66. Similarly, the double nut mounting 64 is disposed within mounting opening 40 with a nut on either side of the second flange 33. The double nut mounting includes threads (not shown) that are structured to allow the nuts 64*a*, 64*b* of the double nut mounting to bear against the second flange 33.

In operation, after the actuator assembly 10 is mounted on the circuit breaker 1, a user would operate the handle attached to handle attachment end 52 to cause cable 54 to move. Moving the cable 54, which is coupled to tab 26, causes the slider assembly 20 to slide between a first position and a second position. Movement of the slider assembly 20 between its first and second position causes the operating handle 2, which is disposed within the formed cutout 25, to move between the operating handle first and second position.

While specific embodiments of the invention have been described in detail, it will be appreciated by those skilled in the art that various modifications and alternatives to those details could be developed in light of the overall teachings of the disclosure. For example, the slider assembly could include a Z-shaped member. Thus, the first and second flanges 32, 33 would not necessarily have to be aligned. Accordingly, the particular arrangements disclosed are meant to be illustrative only and not limiting as to the scope of invention which is to be given the full breadth of the claims appended and any and all equivalents thereof.

What is claimed is:

1. An actuator mechanism for a circuit breaker having an operating handle, said actuator mechanism comprising:

a slider assembly having a rigid, generally planar member with at least one notch;

a mounting plate assembly having at least two generally parallel, spaced flanges and structured to mount on a circuit breaker housing;

one of said at least two flanges structured to cooperate with said at least one notch to allow said slider assembly to be slidably coupled to said mounting plate between said at least two flanges;

said slider assembly has a narrow portion and a wide portion;

said at least two flanges include a first flange and a second flange;

each of said first and second flanges having a slot therein;

said first flange slot sized to correspond to said slider assembly narrow portion; and said second flange slot sized to correspond to said slider assembly wide portion.

2. The actuator mechanism of claim 1, wherein said at least one notch is disposed between said narrow portion and said wide portion.

3. The actuator mechanism of claim 2, wherein:

said first flange includes an opening which communicates with said first flange slot; and said opening sized to correspond to the width of said planar member at said at least one notch.

4. The actuator mechanism of claim 3, wherein said planar member includes two opposing sides, each said side having a notch extending laterally inward.

5. The actuator mechanism of claim 3, wherein said planar member includes a formed cutout structured to fit about said circuit breaker operating handle.

6. The actuator mechanism of claim 5, wherein said formed cutout includes two extensions structured to extend toward said circuit breaker, when said actuator assembly is installed on a circuit breaker.

7. The actuator mechanism of claim 5, wherein said operating handle pivots through a set stroke and wherein said at least one notch and said cutout are spaced apart on said planar member so that when said formed cutout engages said operating handle said at least on notch cannot be aligned with said opening.

8. An actuator mechanism for a circuit breaker having an operating handle, wherein said circuit breaker includes an operating handle which pivots through a generally straight path of travel, said actuator mechanism comprising:

a slider assembly having a rigid, generally planar member with at least one notch;

a mounting plate assembly having at least two generally parallel, spaced flanges and structured to mount on a circuit breaker housing;

one of said at least two flanges structured to cooperate with said at least one notch to allow said slider assembly to be slidably coupled to said mounting plate between said at least two flanges;

said mounting plate assembly includes at least one first attachment opening and at least one second attachment opening; and said at least one first attachment opening disposed generally to the side of the path of travel of said handle.

9. The actuator mechanism of claim 8, wherein said circuit breaker includes a trip unit and a face plate, said trip unit disposed beside said face plate, and wherein said at least one first attachment opening is structured to be disposed on said face plate.

10. The actuator mechanism of claim 9 wherein said slider assembly includes a planar member and a tab disposed at a generally perpendicular angle to said planar member.

11. The actuator mechanism of claim 10, wherein said planar member includes a formed cutout structured to fit about said circuit breaker operating handle.

12. The actuator mechanism of claim 11, wherein said circuit breaker operating handle is structured to travel between a first position and a second position and wherein said slider assembly is structured to slide a sufficient distance so that said formed cutout travels between position adjacent to said circuit breaker operating handle first position and second position.

13. A circuit breaker comprising:

a housing having a faceplate;

an operating handle extending from said face plate;

a trip unit disposed in said housing and having controls adjacent to said faceplate;

an actuator mechanism comprising:

a slider assembly having a rigid, generally planar member with at least one notch;

a mounting plate assembly having at least two generally parallel, spaced flanges and structured to mount on a circuit breaker housing;

one of said at least two flanges structured to cooperate with said at least one notch to allow said slider assembly to be slidably coupled to said mounting plate between said at least two flanges;

said slider assembly has a narrow portion and a wide portion;

said at least two flanges includes a first flange and a second flange;

each of said first and second flanges having a slot therein;

said first flange slot sized to correspond to said slider assembly narrow portion; and said second flange slot sized to correspond to said slider assembly wide portion.

14. The circuit breaker of claim 13, wherein said at least one notch is disposed between said narrow portion and said wide portion.

15. The circuit breaker of claim 14, wherein:

said first flange includes an opening which communicates with said first flange slot; and said opening sized to correspond to the width of said planar member at said at least one notch.

16. The circuit breaker of claim 15, wherein said planar member includes two opposing sides, each said side having a notch extending laterally inward.

17. The circuit breaker of claim 16, wherein said planar member includes a formed cutout structured to fit about said circuit breaker operating handle.

18. The circuit breaker of claim 17, wherein said formed cutout includes two extensions structured to extend toward said circuit breaker, when said actuator assembly is installed on a circuit breaker.

19. The circuit breaker of claim 18, wherein said operating handle pivots through a set stroke and wherein said at least one notch and said cutout are spaced apart on said planar member so that when said formed cutout engages said operating handle said at least one notch cannot be aligned with said opening.

20. A circuit breaker wherein said circuit breaker includes an operating handle which pivots through a generally straight path of travel, said circuit breaker comprising:

a housing having a faceplate;

an operating handle extending from said face plate;

a trip unit disposed in said housing and having controls adjacent to said faceplate;

an actuator mechanism comprising:

a slider assembly having a rigid, generally planar member with at least one notch;

a mounting plate assembly having at least two generally parallel, spaced flanges and structured to mount on a circuit breaker housing;

one of said at least two flanges structured to cooperate with said at least one notch to allow said slider assembly to be slidably coupled to said mounting plate between said at least two flanges;

said mounting plate assembly includes at least one first attachment opening and at least one second attachment opening; and said at least one first attachment opening disposed generally to the side of the path of travel of said handle.

21. The circuit breaker of claim 20 wherein said slider assembly includes a planar member and a tab disposed at a generally perpendicular angle to said planar member.

22. The circuit breaker of claim 20, wherein said planar member includes a formed cutout structured to fit about said circuit breaker operating handle.

23. The circuit breaker of claim 22, wherein:

said circuit breaker operating handle is structured to travel between a first position and a second position; and said slider assembly is structured to slide a sufficient distance so that said formed cutout travels between position adjacent to said circuit breaker operating handle first position and second position.

* * * * *